US006326933B1

(12) United States Patent
Patachi

(10) Patent No.: US 6,326,933 B1
(45) **Date of Patent: *Dec. 4, 2001**

(54) TELESCOPIC ANTENNA AND SYSTEM PROVIDED WITH SUCH AN ANTENNA

(75) Inventor: Nicolae V. Patachi, Le Mans (FR)

(73) Assignee: U.S. Philips Corporation, New York, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/264,043

(22) Filed: Mar. 8, 1999

(30) Foreign Application Priority Data

Mar. 13, 1998 (FR) ..... 98 03139

(51) Int. Cl.[7] ..... H01Q 1/24
(52) U.S. Cl. ..... 343/901; 343/702
(58) Field of Search ..... 343/702, 900, 343/901; H04Q 1/24

(56) References Cited

U.S. PATENT DOCUMENTS 4,860,024 8/1989 Egashira ..... 343/702

FOREIGN PATENT DOCUMENTS

0772255A1 5/1997 (EP) ..... H01Q/9/04
0823748A2 2/1998 (EP) ..... H01Q/1/24
2257837A 1/1993 (GB) .
2308502A 6/1997 (GB) ..... H04B/1/38

*Primary Examiner*—Michael C. Wimer
(74) *Attorney, Agent, or Firm*—Dicran Halajian

(57) ABSTRACT

The invention relates to an antenna with a rod and an antenna head, which antenna is telescopic within a guiding tube having a zone of electric contact with the circuits associated with the antenna. The extremity of the tube is either closed by a plug provided to round the shape of the extremity, or deformed, for example by hot deformation, so as to give it a rounded shape. In either case, the realization is very simple, efficient and inexpensive and may be used in any electronic signal transmission system comprising a telescopic antenna for the transmission and/or reception of these signals.

11 Claims, 2 Drawing Sheets

TELESCOPIC ANTENNA AND SYSTEM PROVIDED WITH SUCH AN ANTENNA

FIELD OF THE INVENTION

The invention relates to a telescopic antenna. It also relates to any electronic system provided with such an antenna, and notably to mobile telephones or wireless telephones.

BACKGROUND OF THE INVENTION

In a large number of electronic signal transmission systems, and notably in portable telephones, the antenna provided for transmission and reception of signals is retractable (for reasons of compactness when the system is inoperative). To this end, the antenna rod is guided during its insertion or retraction, in a semi-rigid tube, for example of synthetic resin material, accommodated in the system (in the example described, in the portable telephone), generally above the electronic card. During assembly of the antenna and the tube in the housing of the system, the end of the tube may damage the electronic components fixed on said card, and notably the contacts to which the antenna is connected.

SUMMARY OF THE INVENTION

It is an object of the invention to provide a retractable antenna in which this drawback is obviated.

To this end, the invention relates to an antenna comprising a rod and an antenna head, said antenna being telescopic within a guiding tube having a zone of electric contact with the circuits associated with the antenna, characterized in that the extremity of the tube is closed by a plug provided to round the shape of said extremity, or alternatively, is deformed itself (with respect to its cylindrical shape) so as to give it a rounded shape.

The document U.S. Pat. No. 4,860,024 shows a portable telephone whose antenna device has a semi-spherical extremity. But this shape does not actually ensure any continuity with the rest of the device. In contrast, in the case of the invention, the solution adopted proves that a continuous geometrical surface is constituted with very great simplicity, having no unevenness nor any relief which may damage the surrounding elements and notably the electric contacts for connecting the antenna to various associated circuits.

The invention also relates to any electronic signal transmission system, such as a telephone, comprising, for the transmission and/or reception of said signals, an antenna which is telescopic within a guiding tube having a zone of contact with the circuits associated with the antenna, characterized in that the guiding tube of said telescopic antenna has a rounded shape at its extremity, which shape is obtained, for example, by hot deformation or by positioning a plug.

These and other aspects of the invention are apparent from and will be elucidated, by way of non-limitative example, with reference to the embodiments described hereinafter.

DETAILED DESCRIPTION OF THE INVENTION

Figure 1:
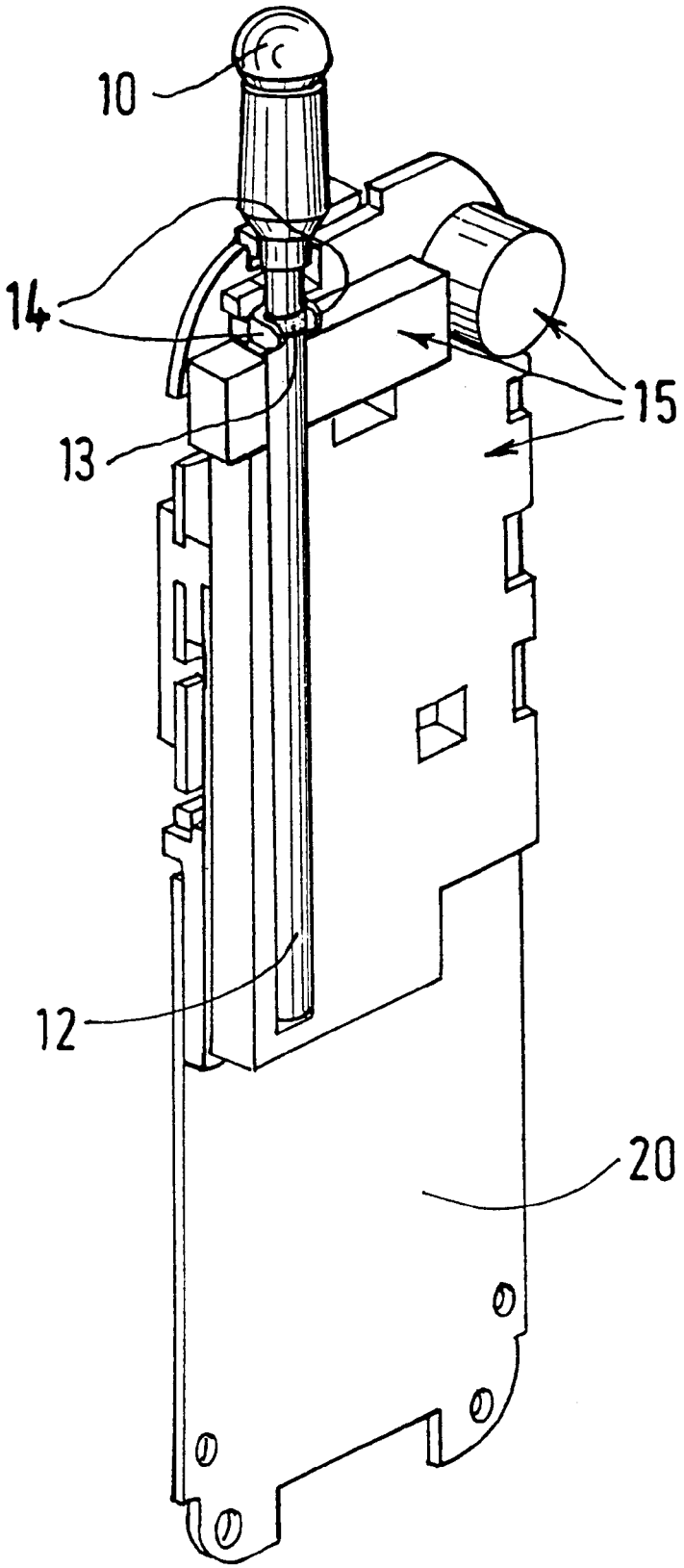
FIGS. 1 and 2 show an example of a retractable antenna and its guiding tube.

FIG. 1 is a perspective view showing, in the case of an apparatus such as a mobile telephone, an example of a retractable antenna having an antenna head 10, which is generally thick enough as a handle and can thus be easily retracted by the user so as to give it an elongated telescopic position (position of operation), and a telescopic rod which is integral with the antenna head 10. The telescopic element formed by the head 10 and this rod slide within a tube 12 constituting a guiding sleeve for this element (in FIG. 1, the antenna is in the inserted position and the tube 12 thus conceals the rod of the telescopic element which is entirely situated within the tube). The tube 12 has a zone 13 of electric contact with the contacts of the circuits associated with the antenna. An example of these circuits 15 is shown in FIG. 1, which shows how said antenna may be positioned with respect to an electronic card comprising these circuits of the system concerned (here, the mobile telephone).

Figure 2:
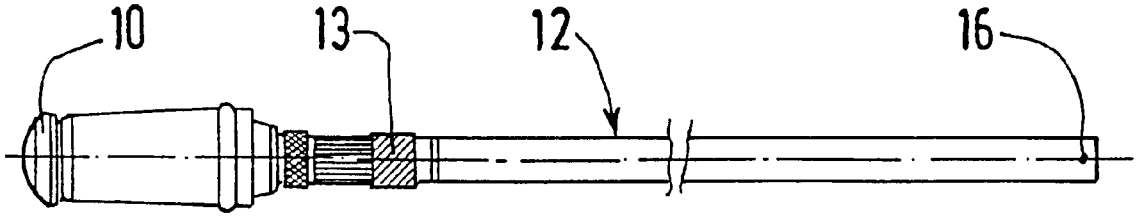

FIG. 2 shows the antenna itself in profile, with the head 10, the tube 12 concealing the rod which is integral with the head 10, and the electric contact zone 13. When the antenna and its hollow tube are assembled in the body of the apparatus with respect to the card and particularly with respect to the reference contacts 14, these contacts might be hit and damaged when the tube is being positioned into said contacts. According to the invention, to obviate this drawback, the extremity 16 of the tube is given a rounder shape, such that the extremity of the tube does not engage the components and notably the contacts and can thus not damage them during said phase of assembly.

Figure 3:
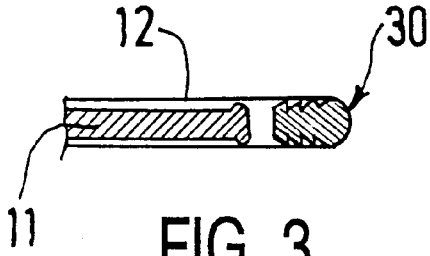
FIGS. 3 and 4 illustrate the principle of the invention.
Figure 4:
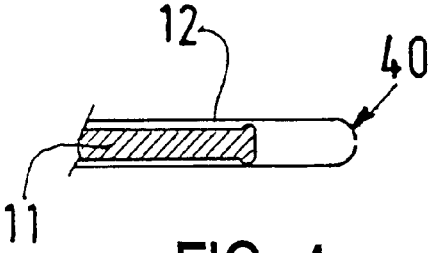

FIG. 3 is a partial view in a longitudinal section of the extremity of the tube and the antenna and shows an embodiment of the invention in which this shape is obtained by positioning a molded and detachable plug 30 at the extremity of the tube 12 comprising the rod 11. This plug smoothes the initial abrupt shape (notably visible in FIG. 2) of the extremity 16 of the tube. A variant shown in a similar way in FIG. 4 consists of modifying the shape of the tube itself and thermally deforming it so as to give it a rounder shape 40 at its extremity. It should be noted that the invention also relates to any electronic signal transmission system such as notably a portable telephone (mobile or wireless) comprising a telescopic antenna as described hereinbefore for the transmission and reception of said signals.

What is claimed is:

1. An antenna comprising:

a head;

a rod connected to said head;

a guiding tube having a first end for insertion of said rod in a bore of said guiding tube through said first end in a retracted position of said antenna, said guiding tube having a second end located opposite said first end; and a plug inserted in said bore at said second end to plug said bore without substantial unevenness between an outer wall of said second end and an exposed surface of said plug.

2. The antenna of claim 1, wherein an exposed portion of said plug has a curved surface and a first part, said first part contacting said tube and having a diameter which is substantially equal to a tube diameter of said tube so that said plug provides a surface which is continuous with said guiding tube and curves at a plug end which is away from said guiding tube.

3. An antenna comprising:

a head;

a rod connected to said head; and a guiding tube having a first end for insertion of said rod in a bore of said guiding tube through said first end in a retracted position of said antenna, said guiding tube having a second end located opposite said first end; said second end being deformed to provide a rounded shape which is continuous with said guiding tube and reduces a diameter of said bore to plug said second end without substantial unevenness between said guiding tube and said rounded shape.

4. The antenna of claim 3, wherein said second end of said guiding tube has a closed rounded end at a furthest end of said guiding tube and has a surface which is continuous with said guiding tube along a direction away from said furthest end.

5. An electronic transmission system comprising an antenna for transmission and/or reception of signals, said antenna comprising:

a head;

a rod connected to said head;

a guiding tube having a first end for insertion of said rod in a bore of said guiding tube through said first end in a retracted position of said antenna, said guiding tube having a second end located opposite said first end; and rounding means inserted in said bore at said second end for rounding said second end to plug said bore without substantial unevenness between an outer wall of said second end and an exposed surface of said rounding means.

6. The electronic transmission system of claim 5, wherein said rounding means is continuous with said guiding tube; and wherein a diameter of said rounding means near said guiding tube is substantially equal to a tube diameter of said guiding tube, said diameter progressively decreasing from an end near said guiding tube to an end that is away from said guiding tube to provide a rounded end.

7. The electronic transmission system of claim 5, wherein a diameter of said rounding means progressively increases from an end away from said guiding tube to an end that is near said guiding tube until said diameter is substantially equal to a tube diameter of said guiding tube.

8. The electronic transmission system of claim 5, wherein said rounding means is a plug inserted in said second end of said guiding tube.

9. The electronic transmission system of claim 5, wherein said rounding means is a plug inserted in said second end of said guiding tube, said plug having a plug diameter which progressively increases from an end away from said guiding tube to an end that is near said guiding tube until said plug diameter is substantially equal to a tube diameter of said guiding tube to provide a continuous surface between said plug and said guiding tube.

10. The electronic transmission system of claim 5, wherein said rounding means is provided by deforming said second end of said guiding tube.

11. The electronic transmission system of claim 5, wherein said rounding means is provided by deforming said second end of said guiding tube so that a diameter of said guiding tube progressively decreases to round said second end.

* * * * *